US011837801B2

(12) United States Patent
Komura et al.

(10) Patent No.: US 11,837,801 B2
(45) Date of Patent: Dec. 5, 2023

(54) ANTENNA MODULE AND COMMUNICATION DEVICE EQUIPPED WITH THE SAME

(71) Applicant: Murata Manufacturing Co., Ltd., Kyoto (JP)

(72) Inventors: Ryo Komura, Kyoto (JP); Yoshiki Yamada, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 343 days.

(21) Appl. No.: 17/226,207

(22) Filed: Apr. 9, 2021

(65) Prior Publication Data

US 2021/0226335 A1 Jul. 22, 2021

Related U.S. Application Data

(63) Continuation of application No. PCT/JP2019/035609, filed on Sep. 11, 2019.

(30) Foreign Application Priority Data

Oct. 12, 2018 (JP) ..... 2018-193291

(51) Int. Cl.
*H01Q 9/04* (2006.01)
*H01Q 1/14* (2006.01)
*H01Q 21/06* (2006.01)

(52) U.S. Cl.
CPC ..... *H01Q 9/045* (2013.01); *H01Q 1/14* (2013.01); *H01Q 21/065* (2013.01)

(58) Field of Classification Search
CPC ..... H01Q 9/045; H01Q 1/14; H01Q 21/065; H01Q 9/0478
See application file for complete search history.

(56) References Cited

U.S. PATENT DOCUMENTS 6,531,984 B1 3/2003 Johannisson et al.
2004/0239567 A1* 12/2004 Van Der Poel .... H01Q 21/0075 343/700 MS
2017/0155185 A1* 6/2017 Hong ..... H01Q 1/24

FOREIGN PATENT DOCUMENTS

CN 203260722 U 10/2013
JP S57-075004 A 5/1982
(Continued)

OTHER PUBLICATIONS

International Search Report for PCT/JP2019/035609 dated Oct. 8, 2019.
Written Opinion for PCT/JP2019/035609 dated Oct. 8, 2019.

*Primary Examiner* — Dieu Hien T Duong
(74) *Attorney, Agent, or Firm* — Pearne & Gordon LLP

(57) ABSTRACT

An antenna module includes a radiation electrode in which a radio frequency signal is supplied to a first feed point and a second feed point. The antenna module further includes a feed wire configured to supply a radio frequency signal to the first feed point of the radiation electrode and a feed wire branching from the feed wire and configured to supply a radio frequency signal to the second feed point. The feed wire includes two paths connected in parallel between the first feed point and the second feed point and having the same length. The paths are disposed so as to be mutually line-symmetric in plan view of the antenna module with respect to a straight line connecting the first feed point to the second feed point.

11 Claims, 11 Drawing Sheets

(56) References Cited

FOREIGN PATENT DOCUMENTS

| | | | |
|---|---|---|---|
| JP | S58-59604 | A | 4/1983 |
| JP | H05-129825 | A | 5/1993 |
| JP | H08-23221 | A | 1/1996 |

* cited by examiner

ANTENNA MODULE AND COMMUNICATION DEVICE EQUIPPED WITH THE SAME

CROSS REFERENCE TO RELATED APPLICATION

This is a continuation of International Application No. PCT/JP2019/035609 filed on Sep. 11, 2019 which claims priority from Japanese Patent Application No. 2018-193291 filed on Oct. 12, 2018. The contents of these applications are incorporated herein by reference in their entireties.

BACKGROUND

Technical Field

The present disclosure relates to an antenna module and a communication device equipped with the same, and more particularly, to a technique for improving cross-polarization discrimination (XPD) in an antenna module.

A patch antenna equipped with a planar antenna element (radiation electrode) has been known. In the patch antenna, in general, a radio frequency signal is supplied to a position shifted from the center of the planar radiation electrode, and a direction in which a radiated radio wave (signal) is polarized is determined depending on the position of a feed point where the radio frequency signal is supplied.

In the patch antenna, a polarized wave (cross-polarized wave) occurs to some extent in a direction orthogonal to the direction in which a radio wave (main polarized wave) is to be radiated. In order to reduce influence of such a cross-polarized wave, a configuration has been known, for example, as disclosed in Japanese Unexamined Patent Application Publication No. 58-59604 (Patent Document 1) in which a pair of feed points is provided in a patch antenna, and radio frequency signals having phases opposite to each other are supplied to the respective feed points. By supplying radio frequency signals having phases opposite to each other, a degree of separation (cross-polarization discrimination: XPD) between the main polarized wave and the cross-polarized wave is improved.

Patent Document 1: Japanese Unexamined Patent Application Publication No. 58-59604

BRIEF SUMMARY

As a measure for supplying signals having phases opposite to each other to two feed points, when a wavelength of a radio wave to be radiated is defined as $\lambda$, a feed wire having a length of $\lambda/2$ may be disposed between the two feed points. However, the present inventors have found that there are cases where XPD is affected depending on the position of a feed wire disposed at a dielectric substrate.

The present disclosure improves XPD in an antenna module having a planar radiation electrode.

An antenna module according to the present disclosure includes a radiation electrode in a flat plate shape to which radio frequency signals are supplied at a first feed point and a second feed point. The antenna module further includes a first feed wire configured to supply a radio frequency signal to the first feed point of the radiation electrode, and a second feed wire branching from the first feed wire and configured to supply a radio frequency signal to the second feed point. The second feed wire includes a first path and a second path connected in parallel between the first feed point and the second feed point and having the same length. The first path and the second path are disposed so as to be mutually line-symmetric in plan view of the antenna module with respect to a straight line connecting the first feed point to the second feed point.

According to the antenna module according to the present disclosure, the two paths (the first path, the second path) of the feed wire connecting the first feed point to the second feed point of the radiation electrode are disposed so as to be mutually line-symmetric with respect to the straight line connecting the first feed point to the second feed point. Accordingly, current distribution in the antenna module becomes symmetric, and thus it is possible to improve XPD.

DETAILED DESCRIPTION

Figure 1:
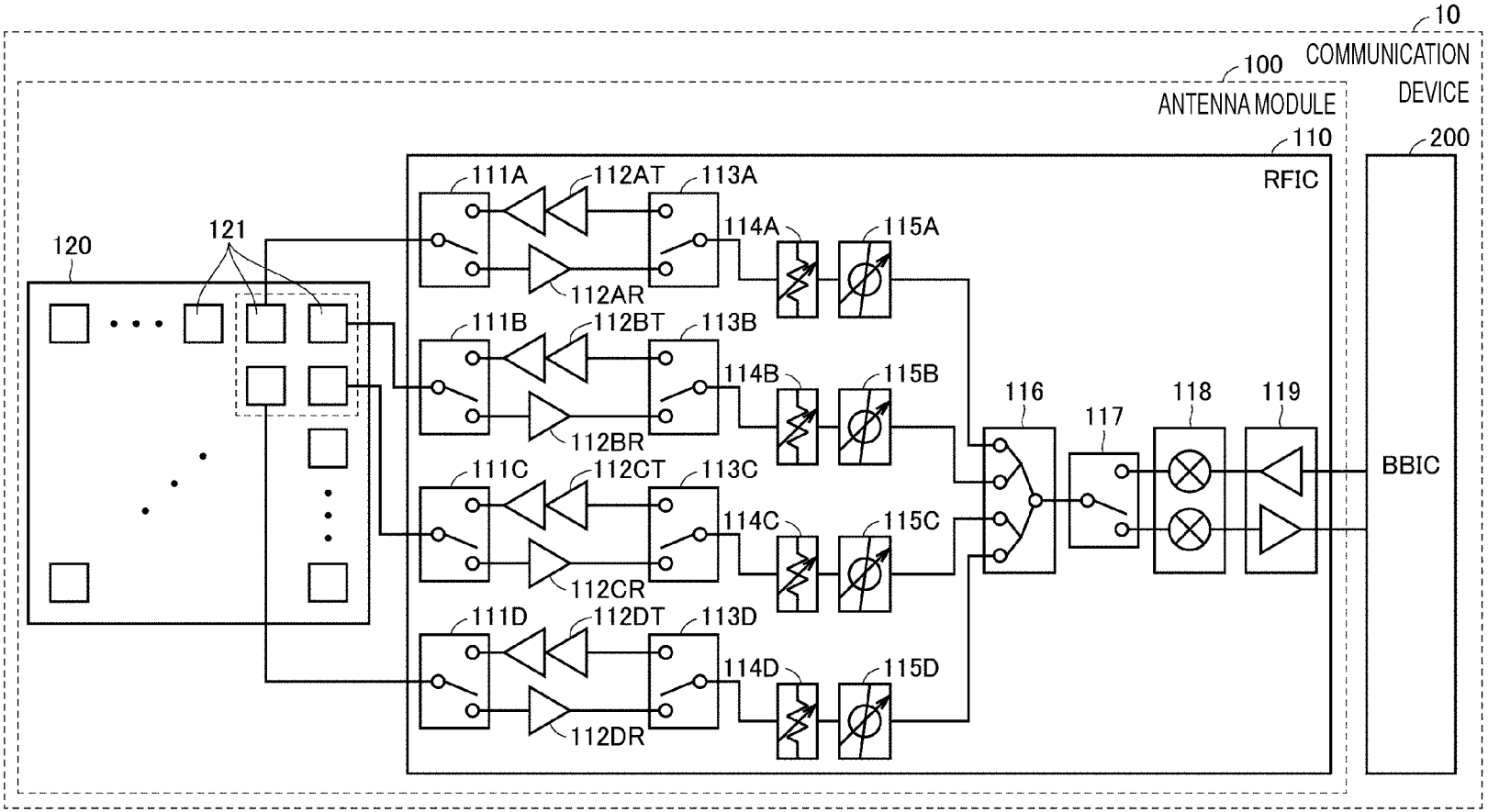
FIG. 1 is a block diagram of a communication device to which an antenna module according to Embodiment 1 is applied.

Hereinafter, embodiments of the present disclosure will be described in detail with reference to the accompanying drawings. Note that, the same or equivalent parts in the drawings are denoted by the same reference numerals, and description thereof will not be repeated.

Embodiment 1

(Basic Configuration of Communication Device)

FIG. 1 is an example of a block diagram of a communication device 10 to which an antenna module 100 according to Embodiment 1 is applied. The communication device 10 is, for example, a mobile terminal, such as a mobile phone, a smartphone, or a tablet, a personal computer having a communication function, or the like. Examples of a frequency band of a radio wave used in the antenna module 100 according to the present embodiment include radio waves in millimeter wave bands having, for example, 28 GHz, 39 GHz, and 60 GHz as respective center frequencies, but the antenna module 100 is applicable to a radio wave in a frequency band other than those described above.

Referring to FIG. 1, the communication device 10 includes the antenna module 100 and a BBIC 200 that constitutes a baseband signal processing circuit. The antenna module 100 includes an RFIC 110, which is an example of a power supply circuit, and an antenna device 120. The communication device 10 up-converts a signal transmitted from the BBIC 200 to the antenna module 100 into a radio frequency signal, radiates the signal from the antenna device 120, and down-converts a radio frequency signal received by the antenna device 120 and processes the signal in the BBIC 200.

In FIG. 1, for ease of description, only a configuration corresponding to, among a plurality of antenna elements (radiation electrodes) 121 constituting the antenna device 120, the four antenna elements 121 is illustrated, and a configuration corresponding to the other antenna elements 121 having a similar configuration is omitted. Note that, in FIG. 1, an example in which the antenna device 120 is formed of the plurality of antenna elements 121 disposed in a two-dimensional array is illustrated, but the number of antenna elements 121 need not necessarily be plural, and the antenna device 120 may be formed of one antenna element 121. In the present embodiment, the antenna element 121 is a patch antenna having a substantially square plate shape.

The RFIC 110 includes switches 111A to 111D, 113A to 113D, and 117, power amplifiers 112AT to 112DT, low noise amplifiers 112AR to 112DR, attenuators 114A to 114D, phase shifters 115A to 115D, a signal multiplexer/demultiplexer 116, a mixer 118, and an amplifier circuit 119.

When a radio frequency signal is transmitted, the switches 111A to 111D and 113A to 113D are switched to the power amplifiers 112AT to 112DT sides, respectively, and the switch 117 is connected to a transmission side amplifier of the amplifier circuit 119. When a radio frequency signal is received, the switches 111A to 111D and 113A to 113D are switched to the low noise amplifiers 112AR to 112DR sides, respectively, and the switch 117 is connected to a reception side amplifier of the amplifier circuit 119.

A signal transmitted from the BBIC 200 is amplified by the amplifier circuit 119 and is up-converted by the mixer 118. A transmission signal, that is the up-converted radio frequency signal, is demultiplexed into four waves by the signal multiplexer/demultiplexer 116, and the four waves pass through four signal paths and are supplied to the antenna elements 121 different from each other, respectively. At this time, degrees of phase shift of the phase shifters 115A to 115D disposed in the signal paths can be individually adjusted so as to adjust directivity of the antenna device 120.

Reception signals that are radio frequency signals received by the respective antenna elements 121 are multiplexed by the signal multiplexer/demultiplexer 116 via the respective four different signal paths. The multiplexed reception signal is down-converted by the mixer 118, amplified by the amplifier circuit 119, and transmitted to the BBIC 200.

The RFIC 110 is formed as, for example, a one-chip integrated circuit component including the above-described circuit configuration. Alternatively, a device (such as switch, power amplifier, low noise amplifier, attenuator, and phase shifter) corresponding to each antenna element 121 in the RFIC 110 may be formed as a one-chip integrated circuit for each corresponding antenna element 121.

(Configuration of Antenna Module)

Figure 2:
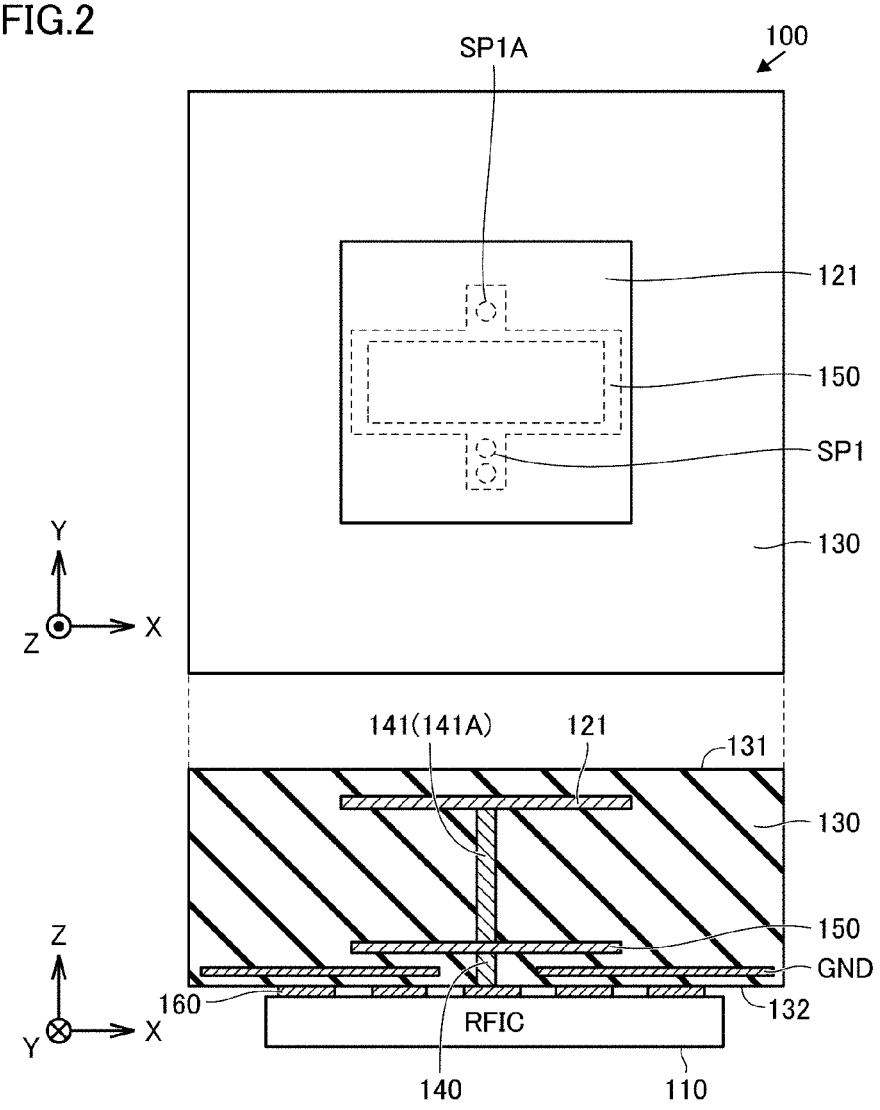
FIG. 2 includes a plan view and a sectional view for describing details of the antenna module in FIG. 1.

FIG. 2 is a diagram for describing details of a configuration of the antenna module 100 according to Embodiment 1. In the antenna module 100 in FIG. 2, for ease of description, a case in which a single antenna element 121 is provided is exemplified, but as illustrated in FIG. 1, a configuration may be adopted in which a plurality of antenna elements 121 is disposed in array. Further, in addition to the antenna element 121 as a power supply element, a parasitic element may be provided as a radiation electrode.

Referring to FIG. 2, the antenna module 100 includes, in addition to the antenna element 121 and the RFIC 110, a dielectric substrate 130, feed wires 140, 141, 141A, and 150, and a ground electrode GND. Note that, in the following description, a positive direction of a Z-axis in FIG. 2 may be referred to as an upper surface side, and a negative direction thereof may be referred to as a lower surface side.

The dielectric substrate 130 is, for example, a substrate in which resin, such as epoxy resin or polyimide resin is formed in multilayer structure. In addition, the dielectric substrate 130 may be formed of a liquid crystal polymer (LCP) having a lower dielectric constant, a fluorine-based resin, a low temperature co-fired ceramics (LTCC), or the like. Further, the dielectric substrate 130 may be a flexible substrate having flexibility.

The dielectric substrate 130 has a substantially square planar shape, and the antenna element 121 having a substantially square shape is disposed in an inner layer or on a front surface 131 on the upper surface side of the dielectric substrate 130. In the dielectric substrate 130, the ground electrode GND is disposed in a layer on the lower surface side lower than the antenna element 121. Further, the RFIC 110 is disposed on a rear surface 132 on the lower surface side of the dielectric substrate 130 with a solder bump 160 interposed therebetween.

A radio frequency signal supplied from the RFIC 110 is transmitted to a feed point SP1 (first feed point) of the antenna element 121 via the feed wires 140 and 141 (first feed wires). The feed point SP1 is disposed at a position offset from the center of the antenna element 121 (an intersection point of diagonal lines) in a negative direction of a Y-axis in FIG. 2. By supplying a radio frequency signal to the feed point SP1, a radio wave polarized in the Y-axis direction is radiated from the antenna element 121.

Further, a radio frequency signal supplied from the RFIC 110 is also supplied to a feed point SP1A (second feed point) via the feed wires 150 and 141A (second feed wires) branching from the feed wire 140. The feed point SP1A is formed at a position offset from the center of the antenna element 121 in a positive direction of the Y-axis that is a position symmetrical to the feed point SP1 with respect to the center of the antenna element 121. Note that, in FIG. 2, the feed wire 150 is formed in a layer between the antenna element 121 and the ground electrode GND, but may be formed in a layer on the lower surface side lower than the ground electrode GND.

Figure 3:
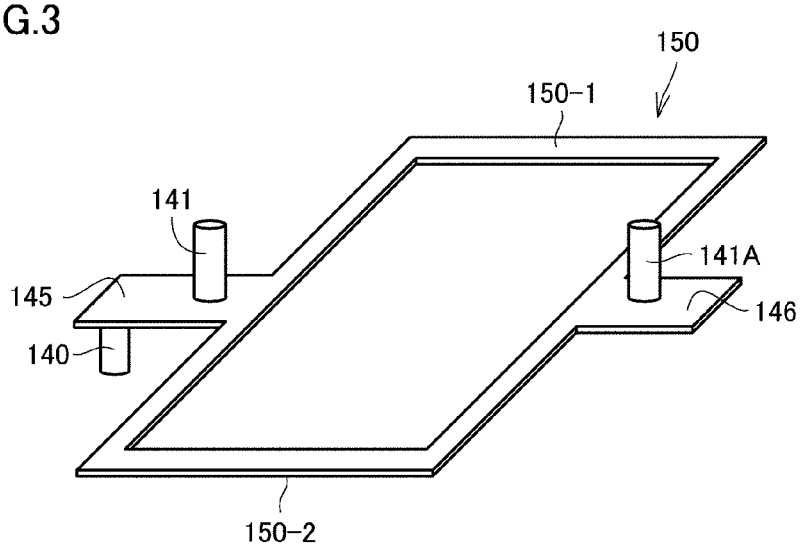
FIG. 3 is a perspective view of feed wires.

FIG. 3 is a perspective view of the feed wires in FIG. 2. The feed wire 140 is formed as a via and is connected to a solder bump on which the RFIC 110 is mounted and to an electrode plate 145 of a layer in which the feed wire 150 is formed. The electrode plate 145 is connected to the feed point SP1 by the feed wire 141, which is also formed as a via.

The feed wire 150 has a rectangular shape elongated in an X-axis direction and having an opening therein. The feed wire 150 is connected to the electrode plate 145 to which the feed wire 141 is connected, and to an electrode plate 146 to which the feed wire 141A is connected. The feed wire 141A is formed as a via, and is connected to the electrode plate 146 and the feed point SP1A.

In plan view of the antenna module 100 in the Z-axis direction, the feed wire 150 includes a first path 150-1 and a second path 150-2 connected in parallel between the electrode plate 145 and the electrode plate 146. Each of the first path 150-1 and the second path 150-2 has a substantially C-shape of the same path length and is disposed in line symmetry with respect to a straight line connecting the feed point SP1 to the feed point SP1A in plan view of the antenna module 100 in the Z-axis direction.

The path length of each of the first path 150-1 and the second path 150-2 of the feed wire 150 is, when a wavelength of a radio frequency signal radiated from the antenna element 121 is defined as λ, set to be approximately λ/2. Accordingly, a phase of a radio frequency signal supplied to the feed point SP1A becomes substantially opposite to a phase of a radio frequency signal supplied to the feed point SP1.

As described above, it is known that XPD between a main polarized wave radiated from an antenna element and a cross-polarized wave orthogonal thereto is improved by supplying radio frequency signals having opposite phases to two feed points disposed at the positions symmetric in a direction in which a radio wave is polarized. For example, also in an antenna module 100# of a comparative example illustrated in FIG. 4, a feed wire 150# connecting the feed point SP1 to the feed point SP1A is provided. The feed wire 150# corresponds to one path of the feed wire 150 in the antenna module 100 of Embodiment 1, and by setting a path length of the feed wire 150# to λ/2, it is possible to supply radio frequency signals having phases opposite to each other to the feed point SP1 and the feed point SP1A.

However, the present inventors have found that, in the antenna module 100# of the comparative example, since the feed wire 150# is asymmetric in the antenna element 121, current distribution in the antenna module is also asymmetric. When the current distribution is asymmetric, there is a possibility that a cross-polarized wave due to the feed wire 150# provided to improve the XPD newly occurs, and the XPD may be inversely affected.

Thus, as a result of intensive studies, the present inventors have reached a configuration of an antenna module capable of improving the XPD by improving asymmetry of the current distribution caused by the feed wire 150#.

In the antenna module 100 according to Embodiment 1, the feed wire 150 for supplying radio frequency signals having opposite phases is symmetrically disposed by the first path 150-1 and the second path 150-2. Thus, since a change in current distribution due to the provision of the feed wire 150 is also symmetrical, it is possible to reduce influence on the XPD.

(Simulation Result)

Figure 4:
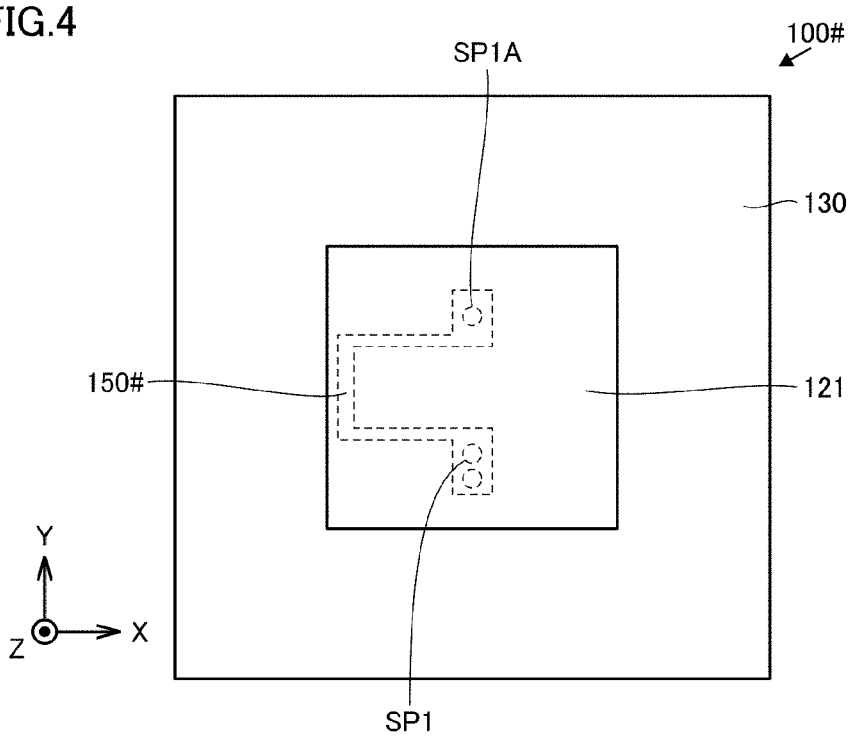
FIG. 4 is a plan view of an antenna module according to a comparative example.

Hereinafter, simulation results for the antenna module 100 of Embodiment 1 illustrated in FIG. 2 and the antenna module 100# of the comparative example in FIG. 4 will be described.

Figure 5:
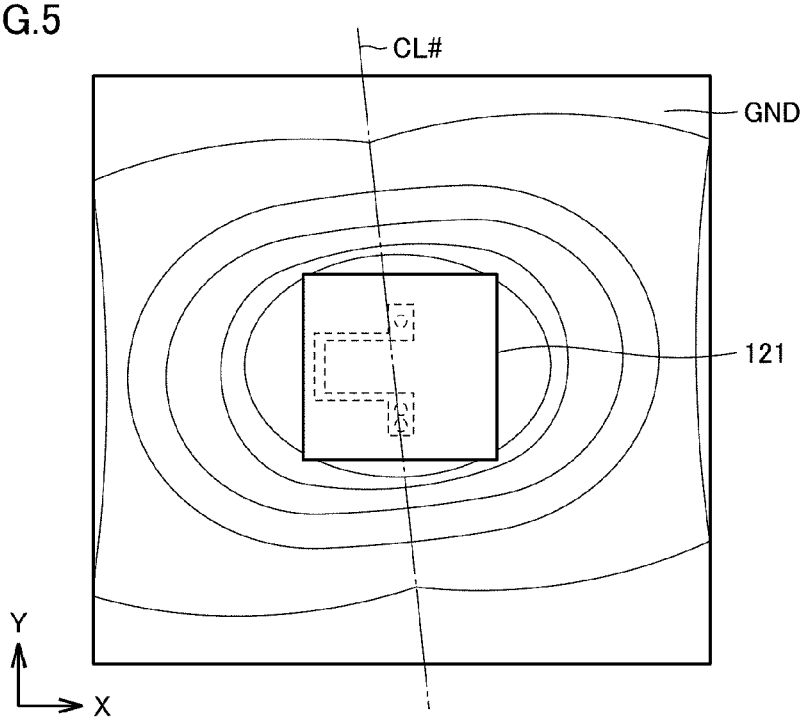
FIG. 5 is an example of current distribution of a ground electrode in the antenna module of the comparative example.
Figure 6:
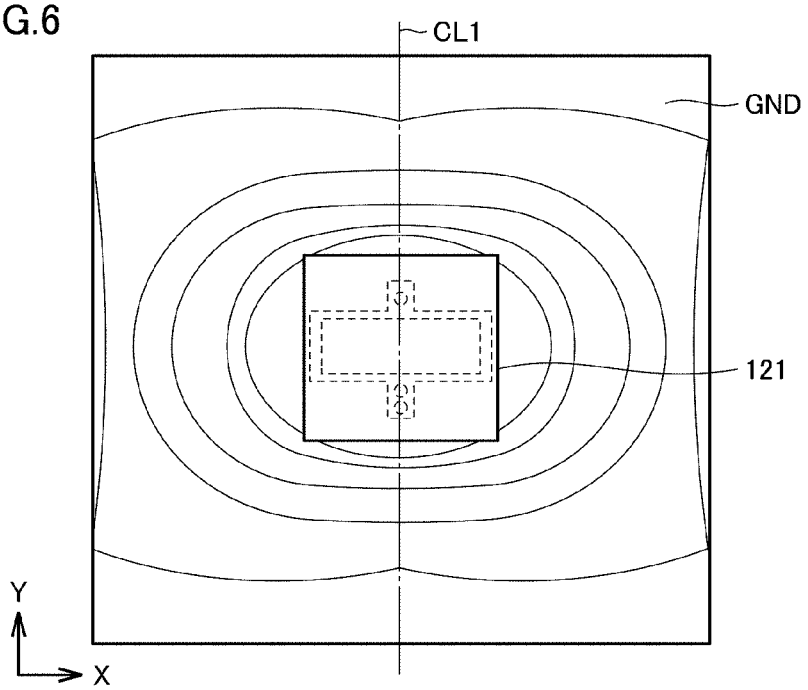
FIG. 6 is an example of current distribution of a ground electrode in the antenna module according to Embodiment 1.

FIG. 5 and FIG. 6 respectively illustrate current distribution in the ground electrode GND for the antenna module 100# of the comparative example and the antenna module 100. In FIG. 5 and FIG. 6, current intensity is represented by contour lines.

In the simulation of the comparative example illustrated in FIG. 5, the current distribution is shifted with respect to the antenna element 121 in a direction (negative direction of an X-axis) in which the feed wire 150# is formed, and a symmetry axis CL# of the current distribution is slightly inclined from the Y-axis direction. On the other hand, in the case of Embodiment 1 illustrated in FIG. 6, the current distribution is symmetrical with respect to the antenna element 121, and a symmetry axis CL1 of the current distribution is substantially parallel to a Y-axis.

Figure 7A:
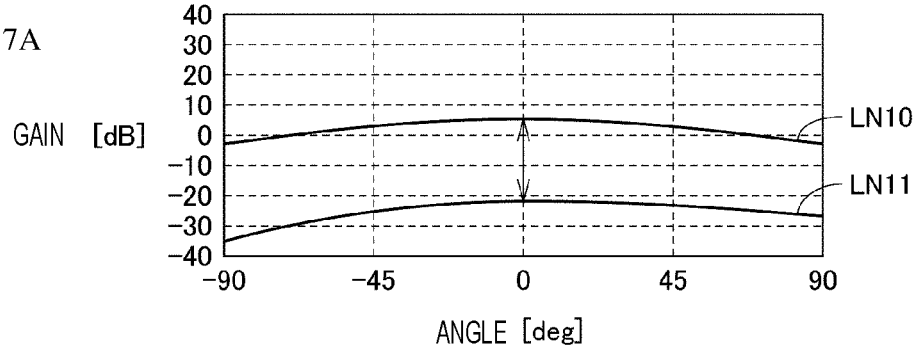
FIGS. 7A and 7B are diagrams for describing comparison of XPD between the comparative example and Embodiment 1.
Figure 7B:
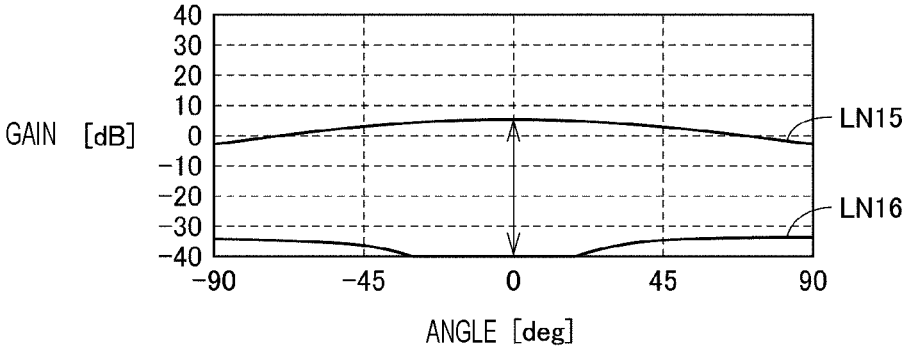

FIGS. 7A and 7B illustrate peak gain of a main polarized wave and a cross-polarized wave in each antenna module in the simulation described above. FIG. 7A in an upper part is a simulation result of the antenna module 100# in the comparative example, and FIG. 7B in a lower part is a simulation result of the antenna module 100 in Embodiment 1.

In FIG. 7A, a line LN10 indicates peak gain of a main polarized wave and a line LN11 indicates peak gain of a cross-polarized wave. Similarly, in FIG. 7B, a line LN15 indicates peak gain of a main polarized wave and a line LN16 indicates peak gain of a cross-polarized wave. XPD is represented by a difference between the peak gain of the main polarized wave and the peak gain of the cross-polarized wave. As shown in FIGS. 7A and 7B, in the antenna module 100 of Embodiment 1, the peak gain of the cross-polarized wave is significantly reduced as compared with the case of the comparative example, and at an angle of 0° (that is, in the Z-axis direction), XPD of approximately 27 dB in the comparative example is improved to be equal to or greater than 45 dB in the configuration of Embodiment 1.

Figure 8:
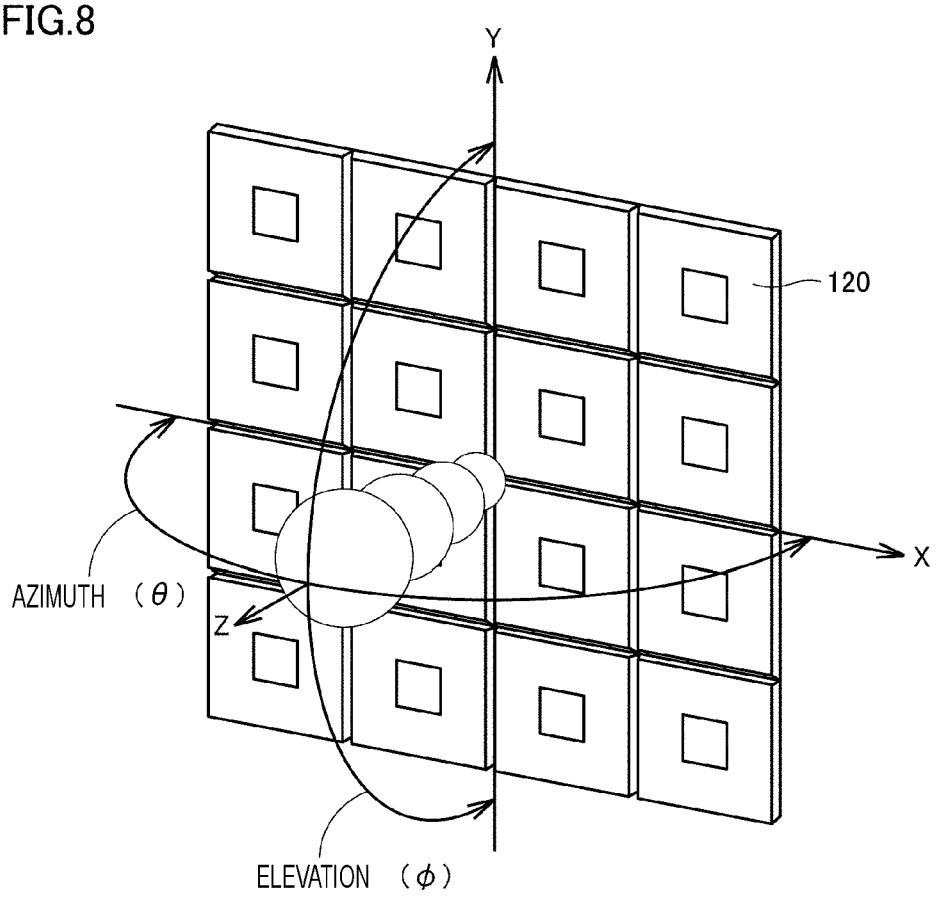
FIG. 8 is a diagram for describing a direction in which directivity is inclined, when the antenna module according to Embodiment 1 is formed as an array.

Next, simulation results in a case of an antenna array in which antenna elements are disposed in array will be described. The simulation is performed for a case where the antenna elements having the configuration of the feed wires of the above-described Embodiment 1 and the comparative example are disposed in array of 4×4 as illustrated in FIG. 8. In the case of the antenna array, a beam direction (directivity) of a radiated radio wave can be inclined by adjusting a phase of a radio frequency signal supplied to each antenna element. Thus, the simulation is also performed for XPD when the beam direction is inclined in an azimuth direction (θ) and when the beam direction is inclined in an elevation direction (φ).

Figure 9A:
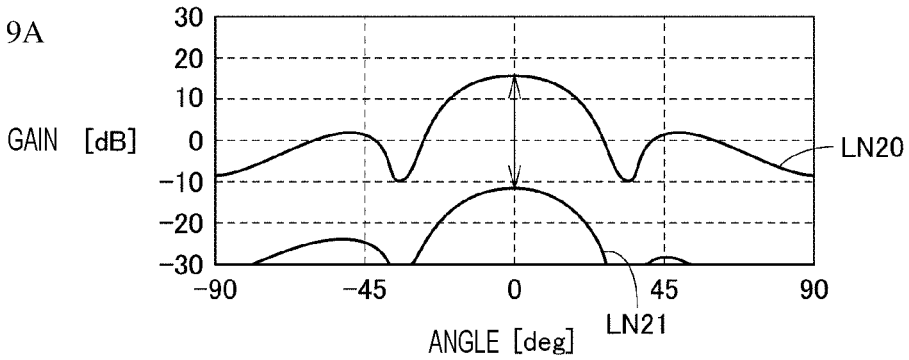
FIGS. 9A and 9B are diagrams for describing comparison of XPD between the comparative example and Embodiment 1 in respective antenna arrays.
Figure 9B:
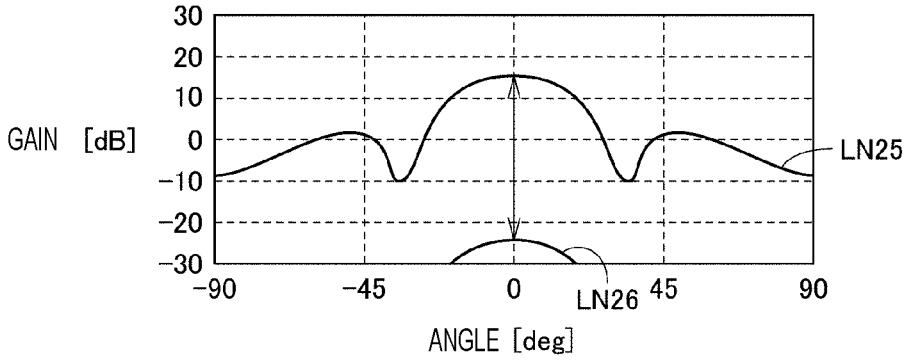

FIGS. 9A and 9B show peak gain of each of a main polarized wave and a cross-polarized wave in a Z-X plane, when a beam direction is the Z-axis direction, that is, when an azimuth θ is 0° and an elevation φ is 0°. FIG. 9A is a simulation result in the comparative example, a line LN20 indicates peak gain of a main polarized wave, and a line LN21 indicates peak gain of a cross-polarized wave. Further, FIG. 9B is a simulation result in Embodiment 1, a line LN25 indicates peak gain of a main polarized wave, and a line LN26 indicates peak gain of a cross-polarized wave.

As indicated in FIGS. 9A and 9B, also in the case of the antenna array, the peak gain of the cross-polarized wave can be significantly reduced by configuring the feed wires as in Embodiment 1 compared to the comparative example, and XPD is improved.

Figure 10:
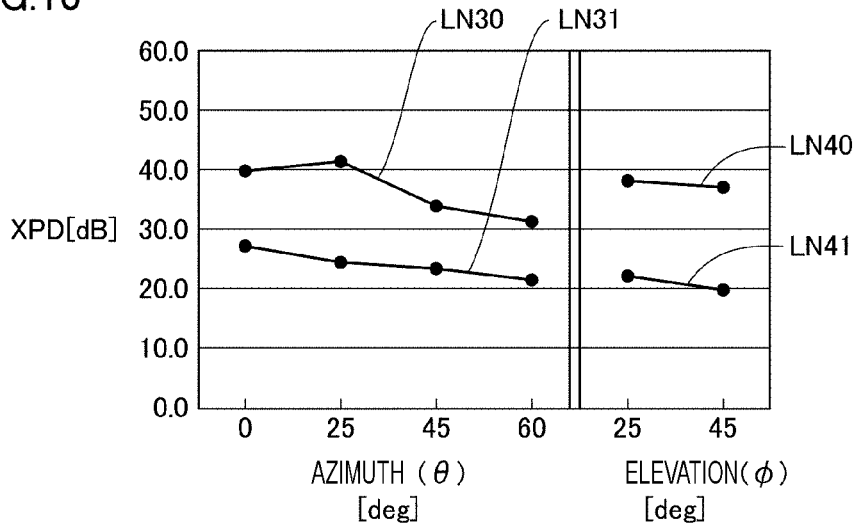
FIG. 10 is a diagram for describing XPD when directivity is inclined.

FIG. 10 illustrates XPD when a beam direction is inclined from 0° to 60° in the azimuth direction, and when the beam direction is inclined from 0° to 45° in the elevation direction. In FIG. 10, a line LN30 and a line LN40 indicate the XPD in Embodiment 1, and a line LN31 and a line LN41 indicate the XPD in the comparative example.

As shown in FIG. 10, in the case where the beam direction is inclined in any of the azimuth direction and the elevation direction, the XPD is also improved in the configuration of Embodiment 1 compared to the configuration of the comparative example.

As described above, in either case of the antenna module having a single antenna element and the antenna module forming an antenna array, symmetry of current distribution of a ground electrode can be improved and the XPD can be improved by disposing the feed wires for supplying radio frequency signal having opposite phases parallel and symmetrically between two feed points.

Comparative Example

In Embodiment 1 described above, as illustrated in FIG. 2 or FIG. 3, the example has been described in which the feed wire 150 has a substantially rectangular shape in plan view of the antenna module, but the feed wire 150 may have other shapes as long as two paths of the feed wire are symmetrically disposed between two feed points, and a length of each path can be set to λ/2.

Figure 11:
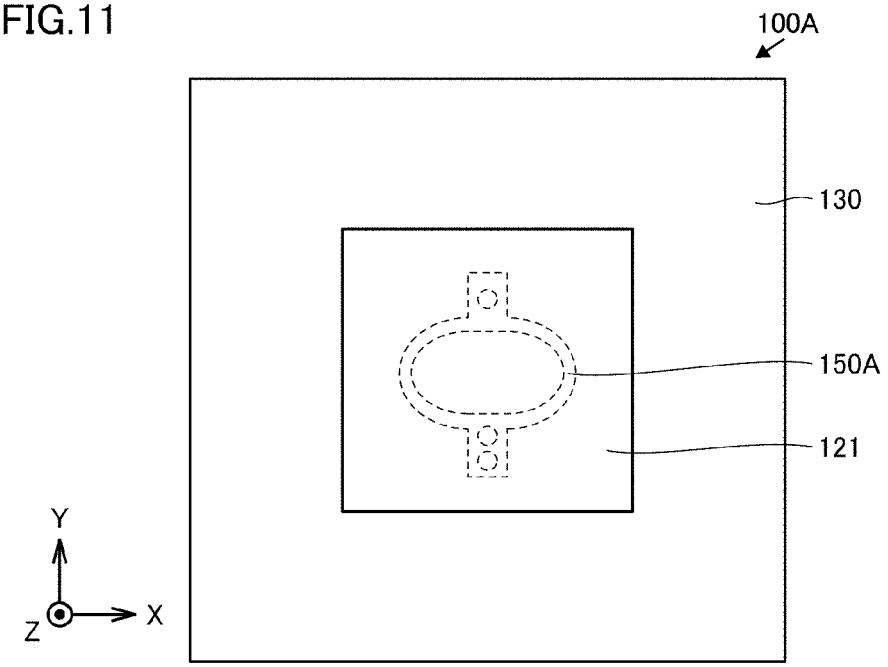
FIG. 11 is a plan view of an antenna module according to Modification 1.
Figure 12:
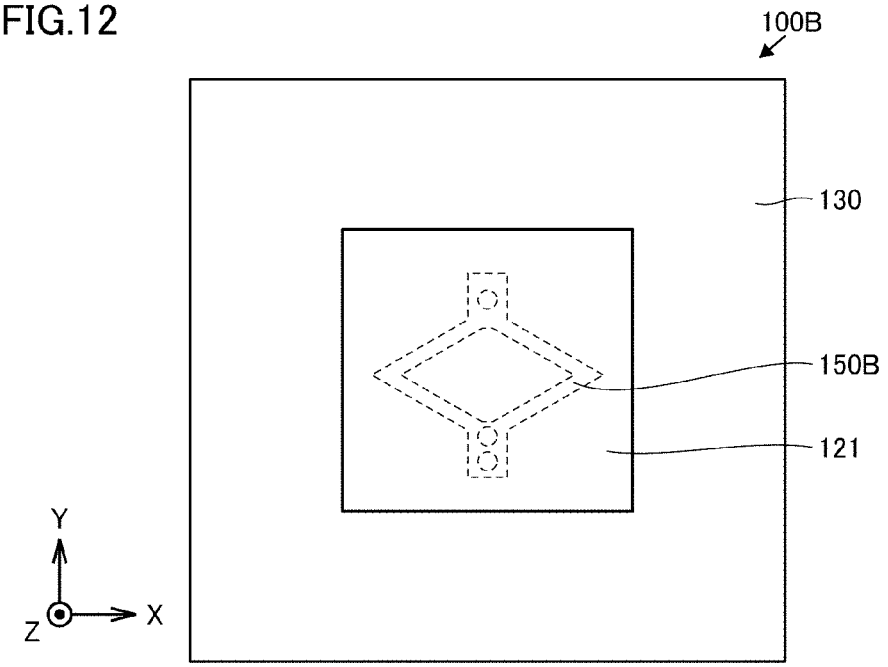
FIG. 12 is a plan view of an antenna module according to Modification 2.

For example, as in an antenna module 100A illustrated in FIG. 11, a configuration may be adopted in which, each path of a feed wire 150A has an arc shape, and the feed wire has a circular shape or an elliptical shape in plan view of the antenna module. Alternatively, as in an antenna module 100B illustrated in FIG. 12, a configuration may be adopted in which, each path of a feed wire 150B has a mountain shape (triangle), and the feed wire has a rhombic shape in plan view of the antenna module.

Figure 13:
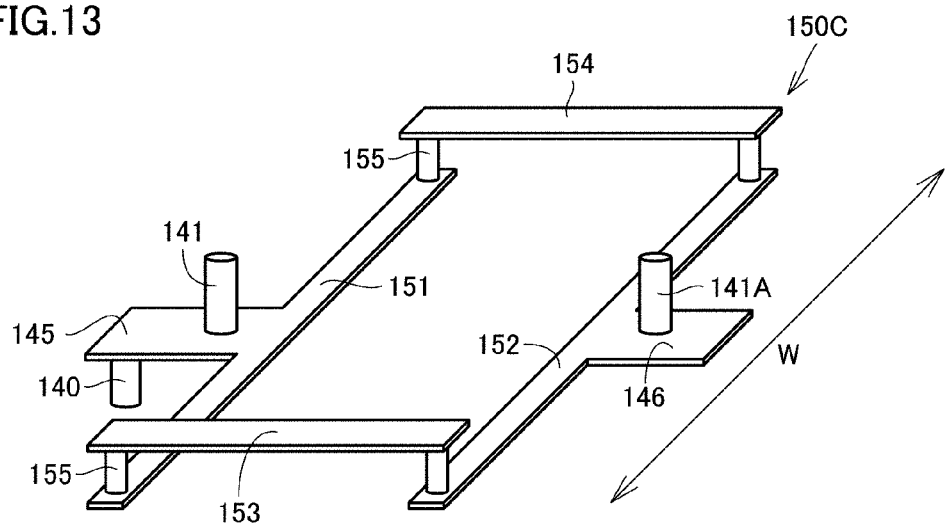
FIG. 13 is a perspective view of feed wires in an antenna module according to Modification 3.

Two paths do not necessarily have to be formed in the same layer and may be formed by using a wiring pattern disposed in a plurality of layers as in a feed wire 150C illustrated in FIG. 13. In the feed wire 150C, wiring patterns 151 and 152 are respectively connected to electrode plates 145 and 146, one ends of the wiring patterns 151 and 152 are connected to each other via a wiring pattern 153 in a different layer by a via 155, and other ends of the wiring patterns 151 and 152 are connected to each other via a wiring pattern 154 in a different layer by the via 155. Note that, in order to ensure symmetry, the wiring pattern 153 and the wiring pattern 154 can be formed in the same layer. As described above, by forming the feed wire 150C using the wiring patterns disposed in the plurality of layers, a dimension in a W direction in FIG. 13 can be reduced, and a degree of freedom in disposition of other components or wires can be improved.

Embodiment 2

In Embodiment 1, the antenna module in which a radiated radio wave is polarized in a single direction has been described. In Embodiment 2, a dual-polarized-wave antenna module in which a radiated radio wave is polarized in two orthogonal directions will be described.

Figure 14:
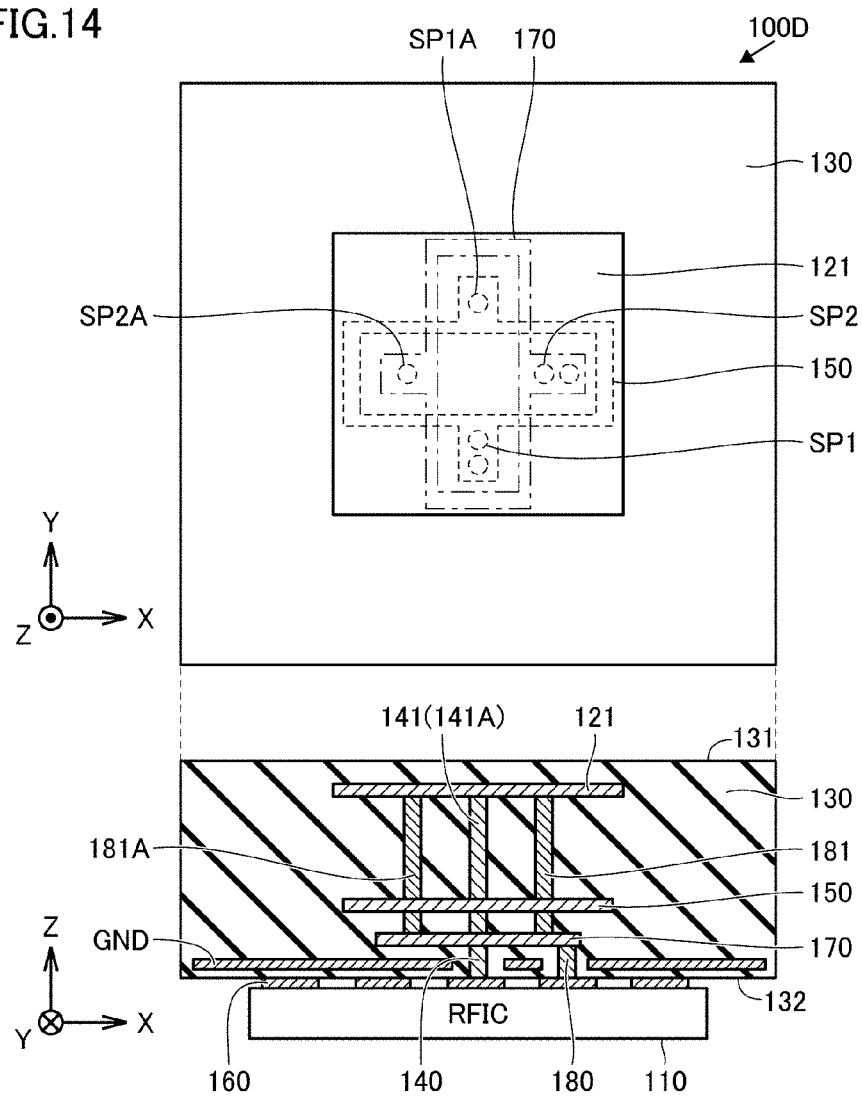
FIG. 14 includes a plan view and a sectional view for describing an antenna module according to Embodiment 2.
Figure 15:
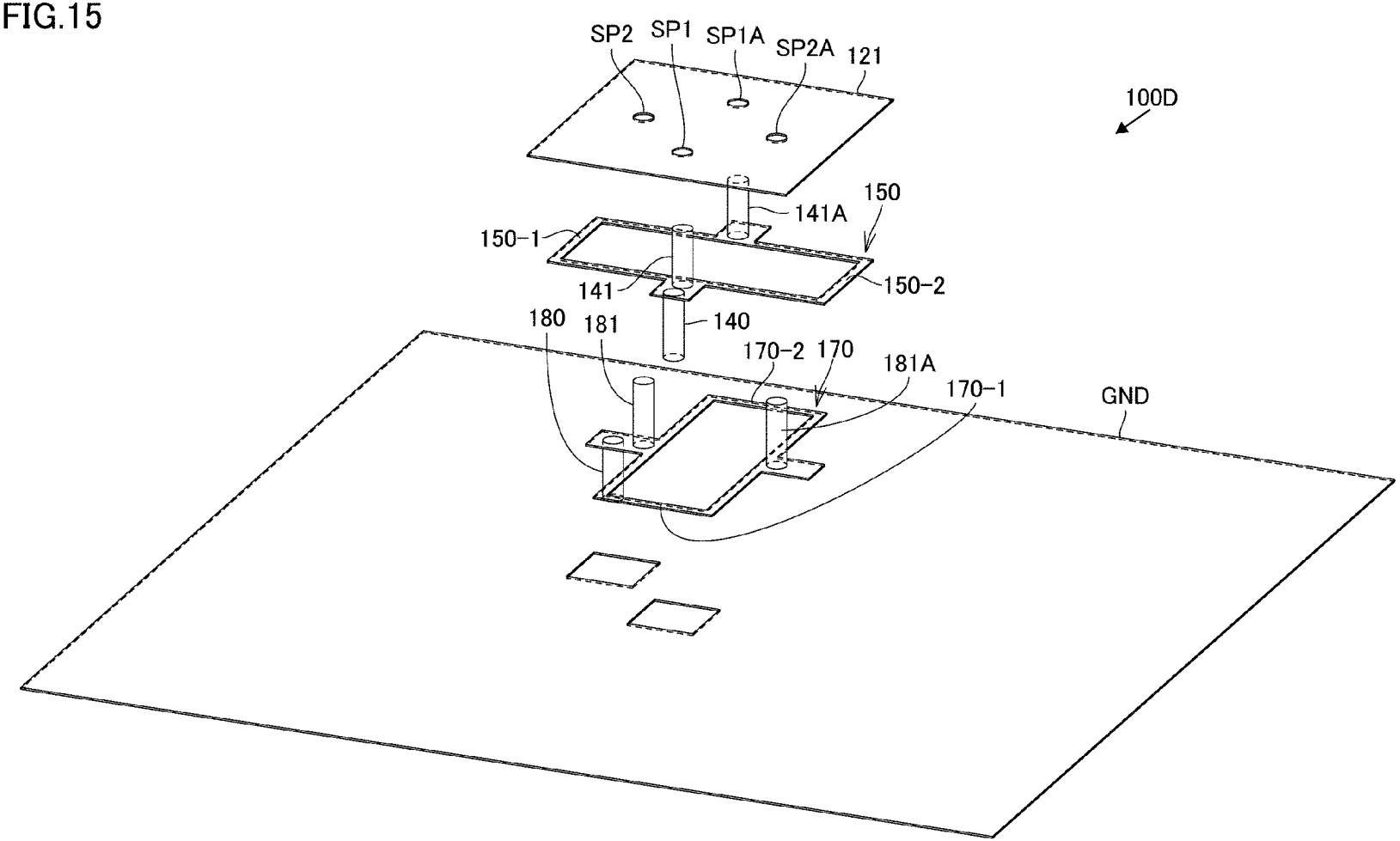
FIG. 15 is an exploded perspective view for describing feed wires in FIG. 14.

FIG. 14 and FIG. 15 are diagrams for describing an antenna module 100D according to Embodiment 2. FIG. 14 includes a plan view and a sectional view of the antenna module 100D. FIG. 15 is an exploded perspective view illustrating a positional relationship between an antenna element, feed wires, and a ground electrode in the antenna module 100D. In the antenna module 100D as well, description will be given as an example by using a case where a single antenna element 121 is provided, but the configuration of the antenna array as illustrated in FIG. 8 may be adopted. Note that, in the description of FIG. 14, the same elements as those illustrated in FIG. 2 are denoted by the same reference numerals, and detailed description thereof will not be repeated.

Referring to FIG. 14, in the antenna module 100D, radio frequency signals are also supplied to feed points SP2 and SP2A in addition to the feed points SP1 and SP1A.

A radio frequency signal supplied from the RFIC 110 is transmitted to the feed point SP2 (a third feed point) of the antenna element 121 via feed wires 180 and 181 (third feed wires). Further, a radio frequency signal supplied from the RFIC 110 is supplied to the feed point SP2A (a fourth feed point) via feed wires 170 and 181A (fourth feed wires) branching from the feed wire 180.

The feed point SP2 is disposed at a position offset from the center of the antenna element 121 in the positive direction of the X-axis, and the feed point SP2A is disposed at a position offset from the center of the antenna element 121 in the negative direction of the X-axis. By supplying radio frequency signals to the feed point SP2 and the feed point SP2, a radio wave polarized in the X-axis direction is radiated from the antenna element 121. That is, a direction in which a radio wave radiated by radio frequency signals received at the feed point SP1 and the feed point SP1A is polarized and a direction in which a radio wave radiated by radio frequency signals received at the feed point SP2 and the feed point SP2A is polarized are orthogonal to each other.

The feed wire 170 has a rectangular shape elongated in the Y-axis direction and having an opening therein. As illustrated in the sectional view of FIG. 14 and the exploded perspective view of FIG. 15, the feed wire 170 is formed in a layer between the feed wire 150 and the ground electrode GND. Similarly to the feed wire 150, the feed wire 170 has two paths (a third path 170-1 and a fourth path 170-2) connected to the feed point SP2 and the feed point SP2A. In plan view of the antenna module 100D, the third path 170-1 and the fourth path 170-2 are disposed so as to be mutually line-symmetric with respect to a straight line connecting the feed point SP2 to the feed point SP2A. Respective path lengths of the third path 170-1 and the fourth path 170-2 are the same, and are set to be approximately λ/2 when a wavelength of a radio frequency signal radiated from the antenna element 121 is defined as λ.

By configuring the feed wire 170 as described above, a phase of a radio frequency signal supplied to the feed point SP2 and a phase of a radio frequency signal supplied to the feed point SP2A are substantially opposite to each other. Accordingly, in the antenna module 100D, it is also possible to improve XPD for radio waves radiated by supplying radio frequency signals to the feed point SP2 and the feed point SP2A.

Embodiment 3

In Embodiment 3, a description will be given of a configuration in which, in a dual-polarized-wave antenna module, a ground electrode is disposed between feed wires 150 and 170 for supplying radio frequency signals having opposite phases.

Figure 16:
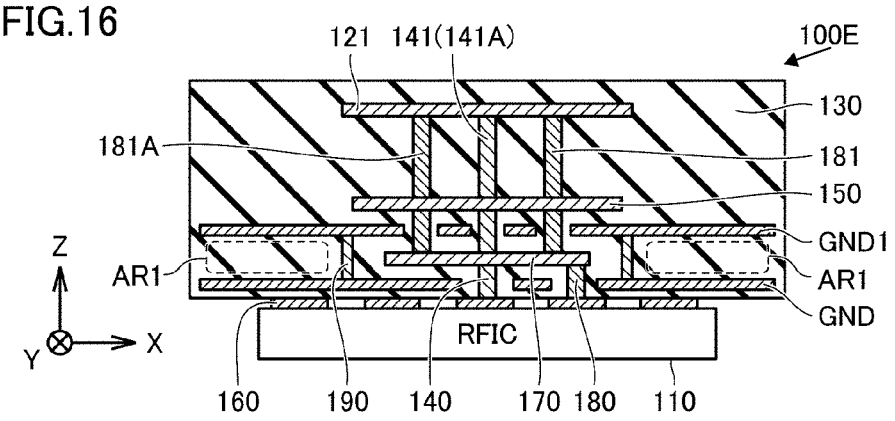
FIG. 16 is a sectional view for describing an antenna module according to Embodiment 3.
Figure 17:
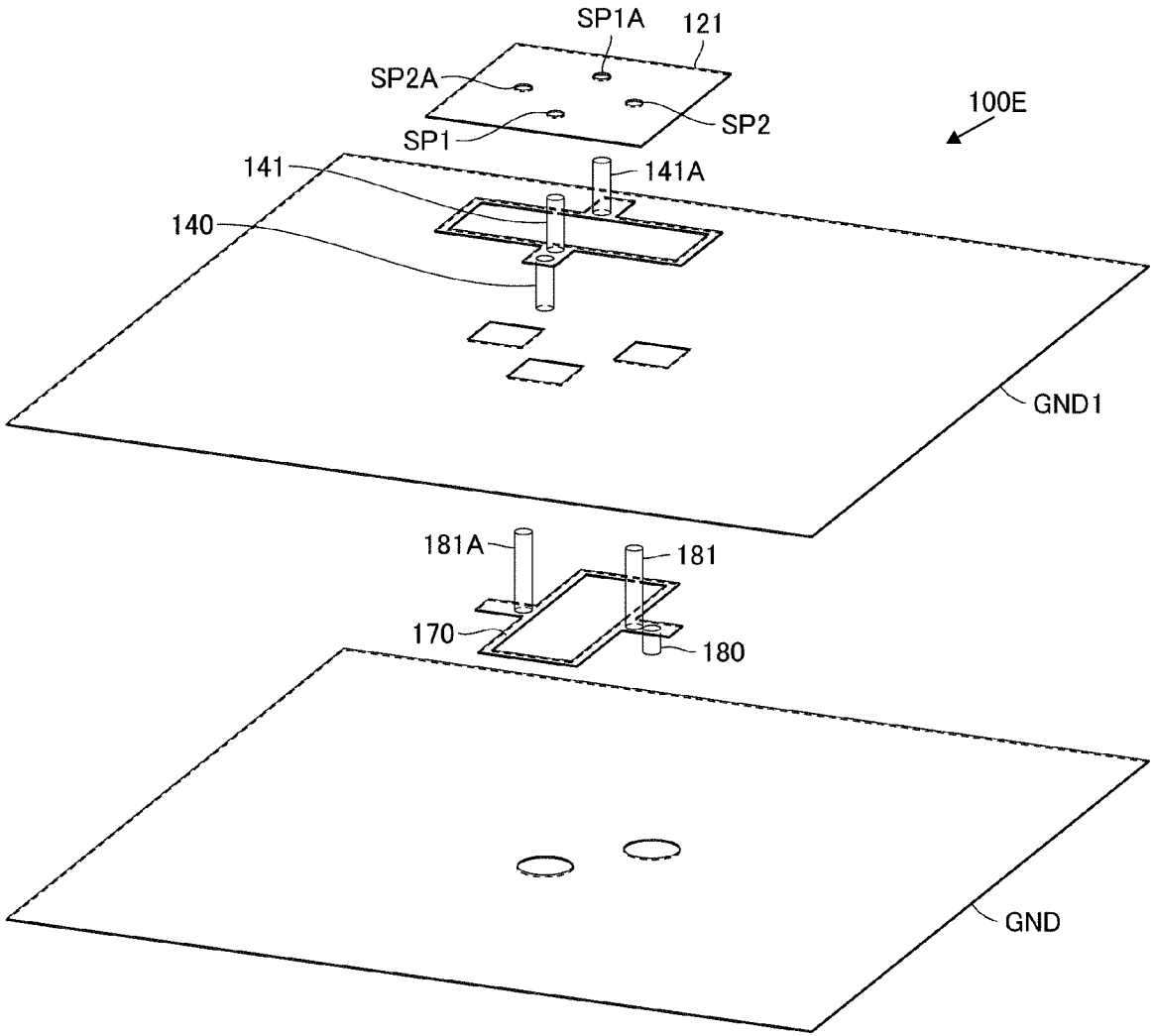
FIG. 17 is an exploded perspective view for describing feed wires in FIG. 16.

FIG. 16 is a sectional view of an antenna module 100E according to Embodiment 3. FIG. 17 is an exploded perspective view illustrating a positional relationship between an antenna element, feed wires, and a ground electrode in the antenna module 100E. In the antenna module 100E as well, description will be given as an example by using a case where a single antenna element 121 is provided, but the configuration of the antenna array as illustrated in FIG. 8 may be adopted. Note that, in the description of FIG. 16, the same elements as those illustrated in FIG. 2 and FIG. 14 are denoted by the same reference numerals, and detailed description thereof will not be repeated.

Referring to FIG. 16 and FIG. 17, the antenna module 100E further includes, in addition to the configuration of the antenna module 100D, a ground electrode GND1 disposed in a layer between a layer in which the feed wire 150 is formed and a layer in which the feed wire 170 is formed. By adopting such a configuration, coupling between the feed wire 150 and the feed wire 170 is suppressed, thus interference between respective polarized waves can be reduced, and antenna characteristics can be easily adjusted.

In addition, the antenna module 100E further includes a plurality of columnar conductors (vias) 190 that connects the ground electrode GND to the ground electrode GND1. In plan view of the antenna module 100E, the vias 190 are disposed so as to surround a periphery of the feed wire 170 disposed between the ground electrode GND and the ground electrode GND1. In a layer between the ground electrode GND and the ground electrode GND1, wiring layers for transmitting other signals are formed in a region (a region AR1 indicated by a broken line) further toward an outer periphery than the via 190, and it is thus possible to reduce an influence of radio frequency signals supplied from the RFIC 110 to the antenna element 121 on these wiring layers.

Note that, in the antenna module 100E of Embodiment 3, the configuration is adopted in which the two ground electrodes GND and GND1 are provided, but a configuration including only the ground electrode GND1 may be adopted in which the ground electrode GND1 is disposed as a ground electrode in a layer between a layer in which the feed wire 150 is formed and a layer in which the feed wire 170 is formed.

In the above-described embodiments and the comparative example, the configuration in which the radiation electrode and the feed wires are formed in a common dielectric substrate has been described. However, the antenna module may have a configuration in which the radiation electrode is disposed outside the dielectric substrate. For example, a configuration may be adopted in which a radiation electrode is disposed in a housing that accommodates a dielectric substrate, and the radiation electrode is connected to a feed wire formed in the dielectric substrate by a cable or a conductor, such as a pin capable of applying elastic force. Further, a configuration may be adopted in which a radiation electrode is formed in a member different from a dielectric substrate, and the member in which the radiation electrode is formed is mounted on the dielectric substrate by solder or the like, and thus the radiation electrode is connected to a feed wire.

It should be considered that the embodiments disclosed herein are illustrative in all respects and are not restrictive. The scope of the present disclosure is indicated by the claims rather than the description of the above-described embodiments, and it is intended to include all modifications within the meaning and scope equivalent to the scope of the claims.

REFERENCE SIGNS LIST

10 COMMUNICATION DEVICE, 100, 100A, 100B, 100D, 100E, 100# ANTENNA MODULE, 110 RFIC, 111A to 111D, 113A to 113D, 117 SWITCH, 112AR to 112DR LOW NOISE AMPLIFIER, 112AT to 112DT POWER AMPLIFIER, 114A to 114D ATTENUATOR, 115A to 115D PHASE SHIFTER, 116 SIGNAL MULTIPLEXER/DEMULTIPLEXER, 118 MIXER, 119 AMPLIFIER CIRCUIT, 120 ANTENNA DEVICE, 21 ANTENNA ELEMENT, 130 DIELECTRIC SUBSTRATE, 140, 141, 141A, 150, 150A to 150C, 170, 180, 181, 181A FEED WIRE, 145, 146 ELECTRODE PLATE, 151 to 154 WIRING PATTERN, 155, 190 VIA, 160 SOLDER BUMP, GND, GND1 GROUND ELECTRODE, SP1A, SP1, SP2, SP2A FEED POINT

The invention claimed is:

1. An antenna module, comprising:

a radiation electrode having a flat plate shape and being configured to receive a first radio frequency signal at a first feed point and a second radio frequency signal at a second feed point;

a first feed wire configured to supply the first radio frequency signal to the first feed point;

a second feed wire that branches from the first feed wire and that is configured to supply the second radio frequency signal to the second feed point, a dielectric substrate having a multilayer structure and comprising the radiation electrode, the first feed wire, and the second feed wire, and a ground electrode in the dielectric substrate, wherein the second feed wire is in a layer between the radiation electrode and the ground electrode, or opposite the radiation electrode across the ground electrode, wherein the second feed wire comprises a first path and a second path that have lengths equal to each other and that are connected in parallel between the first feed point and the second feed point, and wherein as seen in a plan view of the antenna module, the first path and the second path are mutually line-symmetric with respect to a straight line connecting the first feed point to the second feed point.

2. The antenna module according to claim 1, wherein the lengths of the first and second paths are each $\lambda/2$, where $\lambda$ is a wavelength of a radio frequency signal radiated from the radiation electrode.

3. The antenna module according to claim 1, wherein the first path and the second path are wiring patterns in a plurality of layers of the dielectric substrate.

4. The antenna module according to claim 1, further comprising a feed circuit configured to supply radio frequency signals to the radiation electrode.

5. A communication device comprising an antenna module according to claim 1.

6. An antenna module, comprising:

a radiation electrode having a flat plate shape and being configured to receive a first radio frequency signal at a first feed point and a second radio frequency signal at a second feed point;

a first feed wire configured to supply the first radio frequency signal to the first feed point; and a second feed wire that branches from the first feed wire and that is configured to supply the second radio frequency signal to the second feed point, wherein the second feed wire comprises a first path and a second path that have lengths equal to each other and that are connected in parallel between the first feed point and the second feed point, wherein as seen in a plan view of the antenna module, the first path and the second path are mutually line-symmetric with respect to a straight line connecting the first feed point to the second feed point, wherein the radiation electrode is configured to further receive a third radio frequency signal at a third feed point and a fourth radio frequency signal at a fourth feed point, wherein a direction in which polarized radiated radio waves corresponding to radio frequency signals received at the third and fourth feed points are orthogonal to a direction in which polarized radiated radio waves corresponding to radio frequency signals received at the first and second feed points, wherein the antenna module further comprises:

a third feed wire configured to supply the third radio frequency signal to the third feed point, and a fourth feed wire that branches from the third feed wire and that is configured to supply the fourth radio frequency signal to the fourth feed point, the fourth feed wire comprises a third path and a fourth path that have lengths equal to each other and that are connected in parallel between the third feed point and the fourth feed point, and wherein as seen in the plan view of the antenna module, the third path and the fourth path are mutually line-symmetric with respect to a straight line connecting the third feed point to the fourth feed point.

7. The antenna module according to claim 6, further comprising:

a dielectric substrate having a multilayer structure and comprising the radiation electrode, the first feed wire, the second feed wire, the third feed wire, and the fourth feed wire; and a ground electrode in the dielectric substrate in a layer between the second feed wire and the fourth feed wire.

8. The antenna module according to claim 7, wherein the antenna module further comprises a plurality of columnar conductors that are located between the ground electrode and a second surface of the dielectric substrate, and that surround the fourth feed wire, the second surface being opposite a first surface that is closest to the radiation electrode.

9. An antenna module comprising:

a plurality of antenna devices disposed in an array, wherein each of the plurality of antenna devices comprises:

a radiation electrode configured to receive a first radio frequency signal at a first feed point and second radio frequency signal at a second feed point, a first feed wire configured to supply the first radio frequency signal to the first feed point, a second feed wire that branches from the first feed wire and that is configured to supply the second radio frequency signal to the second feed point, a dielectric substrate having a multilayer structure and comprising the radiation electrode, the first feed wire, and the second feed wire, and a ground electrode in the dielectric substrate, wherein, for each antenna device, the second feed wire is in a layer between the radiation electrode and the ground electrode or opposite the radiation electrode across the ground electrode, wherein, for each antenna device, the second feed wire comprises a first path and a second path that have lengths equal to each other and that are connected in parallel between the first feed point and the second feed point, and wherein, for each antenna device, as seen in plan view of the antenna module, the first path and the second path are mutually line-symmetric with respect to a straight line connecting the first feed point to the second feed point.

10. The antenna module according to claim 9, further comprising a feed circuit configured to supply radio frequency signals to the radiation electrode.

11. A communication device comprising an antenna module according to claim 9.

* * * * *